United States Patent [19]

Johnson

[11] 4,197,980

[45] Apr. 15, 1980

[54] BOX WITH REINFORCED CORNERS

[75] Inventor: Ronald V. Johnson, Port Washington, Wis.

[73] Assignee: Champion International Corporation, Stamford, Conn.

[21] Appl. No.: 971,887

[22] Filed: Dec. 21, 1978

[51] Int. Cl.[2] ..... B65D 5/24; B65D 5/22

[52] U.S. Cl. ..... 229/34 R

[58] Field of Search ..... 229/33, 34, 35, 31 FS, 229/31 R

[56] References Cited

U.S. PATENT DOCUMENTS

| | | | |
|---|---|---|---|
| 2,155,450 | 4/1939 | Shoemaker | 229/35 X |
| 2,334,786 | 11/1943 | Myers | 229/35 UX |
| 2,366,304 | 1/1945 | Williams et al. | 229/35 X |
| 3,003,676 | 10/1961 | De Nola | 229/35 X |
| 3,093,291 | 6/1963 | Brandle | 229/35 |
| 3,144,134 | 8/1964 | Frommgen | 229/34 R X |
| 3,203,619 | 8/1965 | Wilson | 229/35 X |
| 3,784,083 | 1/1974 | Pfaffendorf | 229/34 R |
| 3,883,067 | 5/1975 | McGlynn et al. | 229/34 R X |

*Primary Examiner*—Davis T. Moorhead

*Attorney, Agent, or Firm*—Evelyn M. Sommer

[57] ABSTRACT

One piece die-cut card- or corrugated board structure of the storage bin includes a bottom panel, two opposite side wall panels connected respectively to the lateral sides of the bottom panel along lateral score lines, a front wall panel connected to the front side of the bottom panel along the front score line, a front locking panel connected to the outer side of the front wall panel along intermediate front score lines, short front flap connected to a lower portion of the front side of each side wall panel along a short score line, elongated tuck flaps connected respectively at their short sides to each lateral side of the front locking panel along a score line and further including two equally spaced score lines extending parallel to the doubled score line, tuck slots provided in the front end portion of each side wall panel opposite the short front flap, front locking means including front lock tabs projecting from the outer side of the front locking panel; and front lock slots provided in the front end portion of the bottom panel to engage the front locking tabs. In the assembled condition the elongated tuck flaps pass through the tuck slots from inside to outside and the end portion of each tuck flap is inserted into the space resulting between the short front flap and the front panel.

4 Claims, 6 Drawing Figures

BOX WITH REINFORCED CORNERS

BACKGROUND OF THE INVENTION

This invention relates generally to cardboard or corrugated board boxes and more particularly it relates to a die-cut storage bin having reinforced corners.

Cardboard or corrugated board storage boxes or bins are installed usually on racks and are used for storing a variety of merchandise. Conventional storage bins of this type include a cut down front wall and full size side walls having a curved cut down profile. In addition, they include a U-shaped pad extending over their full depth.

The disadvantages of such conventional storage bins lie in the fact that they are assembled of two die-cut board pieces and therefore their strength and resistance to wear, especially in corner areas, is limited.

SUMMARY OF THE INVENTION

It is therefore a general object of the present invention to overcome the aforementioned disadvantages.

More particularly it is an object of the present invention to provide an improved storage bin which is assembled of a single die-cut piece of card- or corrugated board.

An additional object of the invention is to provide such an improved storage bin which has triple reinforced front wall corners to provide a substantially increased strength over prior art structures and to enhance handling characteristics.

A further object of the invention is to provide an improved storage bin which has an increased structural strength without having had to use staples.

A still further object of the invention is to provide a storage bin having a front wall reduced in height but reinforced in thickness and triple reinforced in corner areas and further having full size side walls and a full size rear wall.

In keeping with these objects, and others which will become apparent hereafter, one feature of the invention resides in the provision of a card- or corrugated board structure which comprises a bottom panel, two opposite side wall panels connected respectively to lateral sides of the bottom panel along lateral score lines, a rear wall panel connected to the rear side of the bottom panel along a rear score line, a front wall panel connected to the front side of the bottom panel along a front score line, a front locking panel connected to the outer side of the front wall panel along intermediate front score lines, short front flaps connected respectively to a lower portion of the front side of each side wall panel along a short score line extending substantially from and in alignment with the front score line, tuck means including elongated tuck flaps connected respectively at their short side to each lateral side of the front locking panel along a doubled score line and in the preferred embodiment including two equally spaced score lines extending parallel to the doubled score line, and tuck slots provided in the front end portion of each side wall panel opposite the short front flap, front locking means including front lock tabs projecting from the outer side of the front locking panel, and front lock slots provided in the front end portion of the bottom panel to engage the front locking tabs when the box is in its assembled condition; in the assembled condition the elongated tuck flaps pass through the tuck slots from the inside and the end portion of each tuck flap is inserted from the outside into the space resulting between the short front flap and the front panel.

The above described structure is applicable for boxes having walls of uniform height and triple reinforced corners both at its front wall and at its rear wall.

If it is desired to make a die-cut storage bin which has side walls and the rear wall higher than the reinforced front wall, the rear wall panel is extended in length to include a rear locking panel connected to the outer side of the rear wall panel along an intermediate doubled rear score line, and further includes a rear flap connected to the rear side of each side wall panel along a score line extending substantially from and being in alignment with the rear score line, rear locking means including rear lock tabs projecting respectively from the lateral sides of the rear locking panel, rear locking slots provided respectively in the rear end portion of the side wall panel to receive the lock tab when the box is folded in its assembled condition.

In a modification of this invention, the tuck means include short tuck flaps corresponding in length to the width of the short front flap and an additional reinforcing flap is made in the upper front end portion of the side walls of the box, the reinforcing flap being provided with a locking tab that engages a matching locking slots provided in the bottom panel of the box.

The novel features which are considered as characteristic for the invention are set forth in particular in the appended claims. The invention itself, however, both as to its construction and its method of operation, together with additional objects and advantages thereof, will be best understood from the following description of specific embodiments when read in conjunction with the accompanying drawing.

DESCRIPTION OF THE PREFERRED EMBODIMENTS

Figure 1:
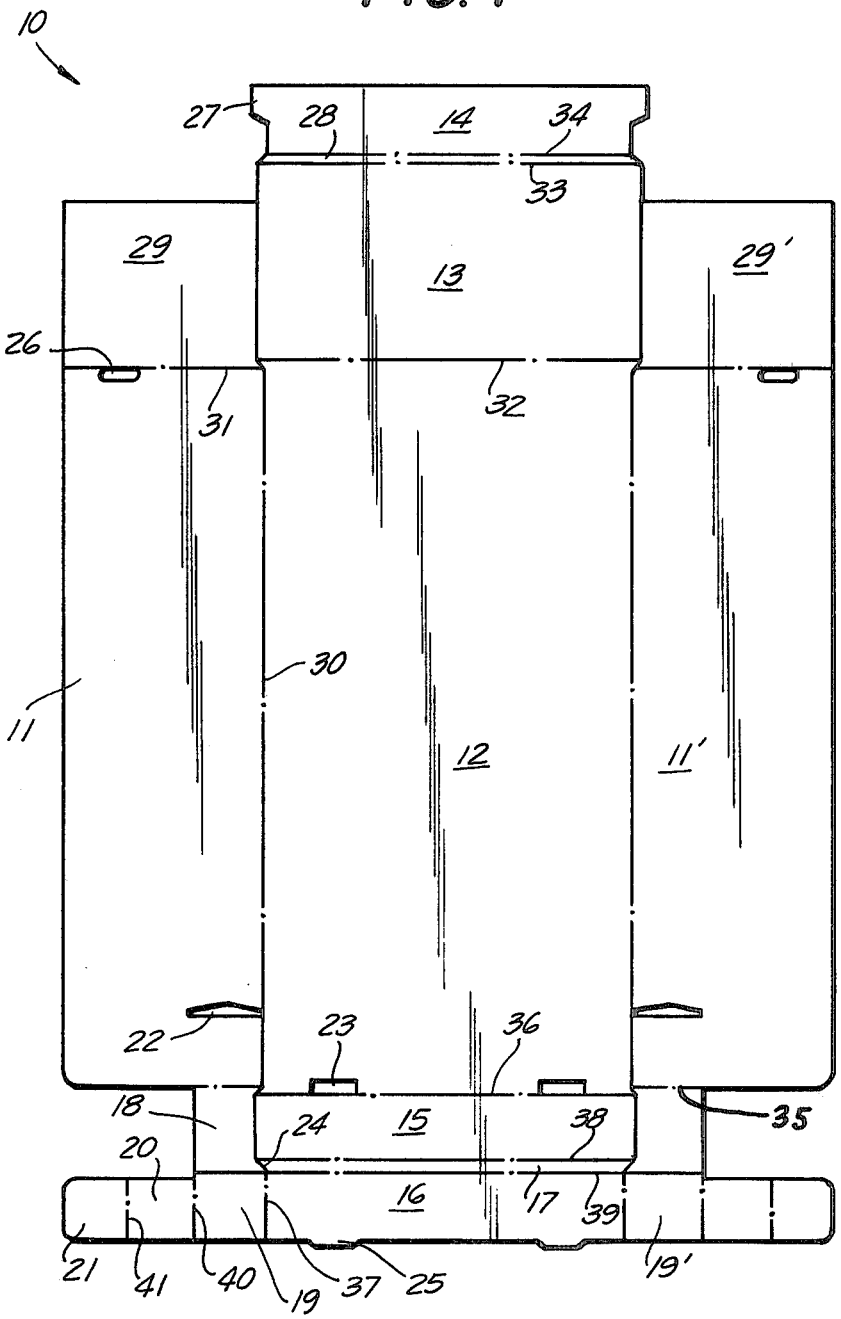
FIG. 1 is a top view of a preferred embodiment of the structure of the box of this invention shown in its unfolded condition.
Figure 2:
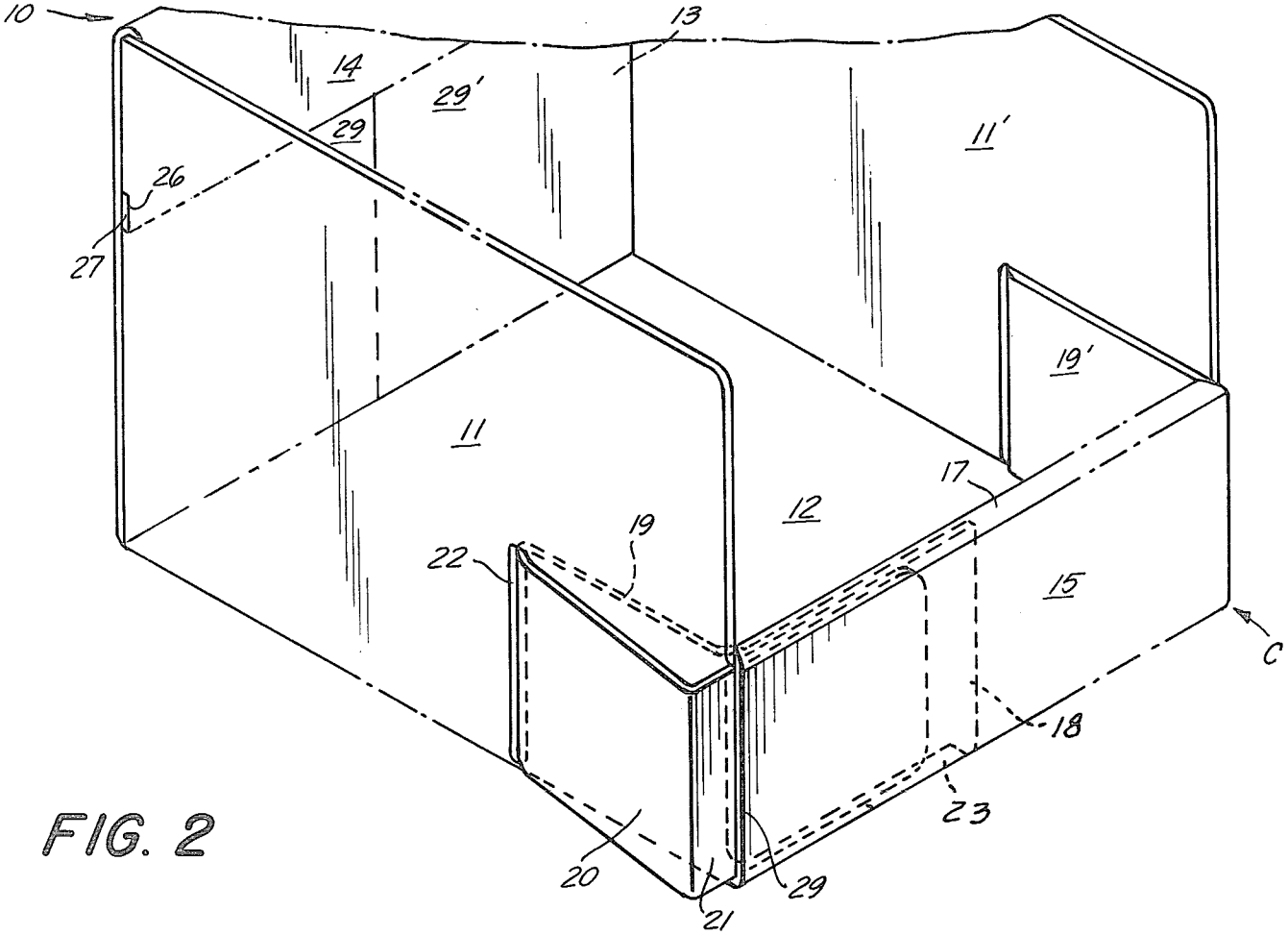
FIG. 2 is a perspective view of the box of FIG. 1 shown in its assembled condition.

Referring to FIGS. 1 and 2, there is shown the preferred embodiment of storage bin 10 according to this invention which in its assembled condition forms side walls 11 and 11' extending over the entire length of the box, a rear wall 13 having the same height as the side walls and a front wall 15 of reduced height and having triple reinforced corners C.

As seen from FIG. 1, the box structure in this instance is formed of a single piece of cardboard by die-cutting and defines a bottom panel 12, side walls 11 and 11' integrally connected to respective lateral sides of the bottom panel along lateral score lines 30. Rear Wall panel 13 is integrally connected to the rear side of the bottom panel 12 along score line 32 and at the opposite side is integrally connected along spaced score lines 33 and 34 with rear locking panel 14. The spacing between score lines 33 and 34 corresponds approximately to the thickness of the cardboard. Front wall 15 extends from the front side of the bottom panel 12 bounded by score line 36 and is connected by an intermediate panel portion 17 extending between score lines 38 and 39 with front locking panel 16. Lateral sides of the front locking panel are integrally connected along score lines 37 with elongated tuck flaps each formed by tuck flap portions 19, 20 and 21 separated from one another by score lines 40 and 41 directed parallel to the score line 37. Rear flaps 29 are connected along score lines 31 to the rear side of each side wall 11. Lower portions of front sides of side walls 11 are provided respectively with short front flap 18 connected to the side wall along score line 35. The short front flap 18 extends as far as to the tuck flap portion 19 and its lateral side facing the front wall 15 is partly recessed and only its end portion is provided with a projection 24 which can be in the nature of a locking projection, the function of which will be explained below. In order to lock the box when the cardboard structure is folded in its assembled condition, each lateral side of the rear locking panel 14 is partly recessed to form at its end portion a lock tab 27 that is engageable with rear lock slot 26 provided in the rear end portion of the side walls 11 and 11'. Similarly, the free front side of the front locking panel 16 is provided with front lock tabs 25 engageable into front lock slots 23 provided in the bottom panel 12. The front lock slots 23 receive also the projecting portion 24 of the short front flap 18 and the front lock tabs snugly fit between the projection 24 and the remainder of the lock slot 23. According to one feature of this invention, side walls 11 are provided with elongated tuck slots 22 located opposite the short front flap 18 and spaced apart therefrom a distance corresponding substantially to the length of tuck flap portions 19 or 20.

The storage bin according to this example is assembled as follows: long side panels 11 and 11' are first folded 90° into an upright position. Then rear flap extensions 29 are rotated 90° to apposite each other into alignment with the score line 32 on the rear side of the bottom panel. Then back panel formed by the rear wall 13 and rear locking panel 14 is folded along score line 32 and short rear locking panel 14 is bent inwardly along score lines 33 and 34 and the rear lock tabs 27 engage lock slots 26 in side walls 11 and 11'. The side walls should then be pressed inward to more tightly engage the lock tabs 27. Thereafter, the short front flaps 18 attached to the side walls 11 are rotated 90° about score line 35 and the front panel is brought into an upright position by turning it about the score line 36. The tuck flaps 19, 20 and 21 on the sides of the front locking panel 16 are bent backwards on their innermost score line 37. This backward folding permits folding the front locking panel 16 180° inwardly along score lines 38 and 39 and readies tuck flap portions 20 and 21 for insertion into the tuck slots 22 in the side walls 11. The tuck flap portions 20 and 21 go through the slots 22 from inside to outside, are brought forward and the end tuck portion 21 is then bent 90° and inserted into the space resulting between the short front flap 18 and the front locking panel 15 (FIG. 2).

The assembled storage box has full length and height of side walls and of the rear wall and its lower front wall has triple reinforced corners resulting in a superior wear resistance and improved handling ability.

Figure 3:
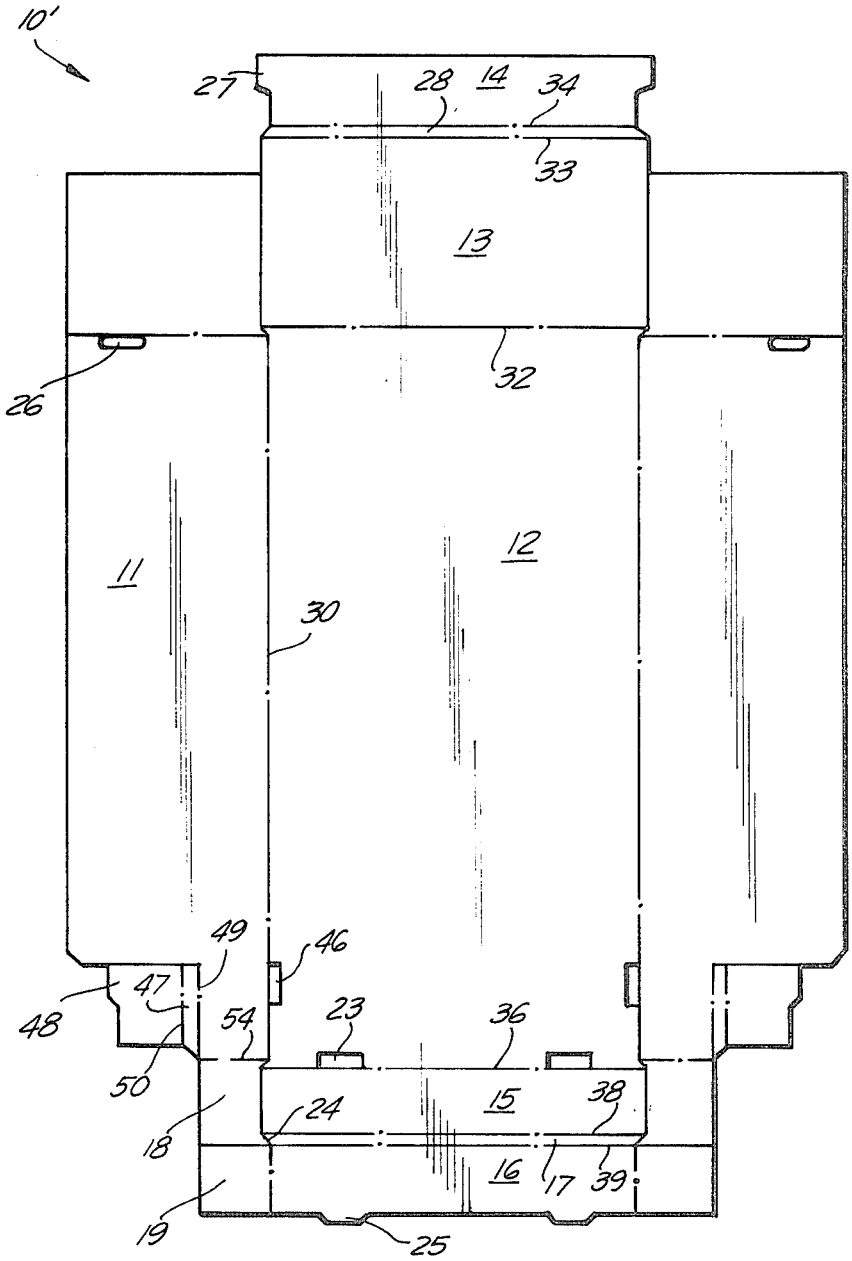
FIG. 3 is a top view of a modification of the box structure of FIG. 1 shown in its unfolded condition.
Figure 4:
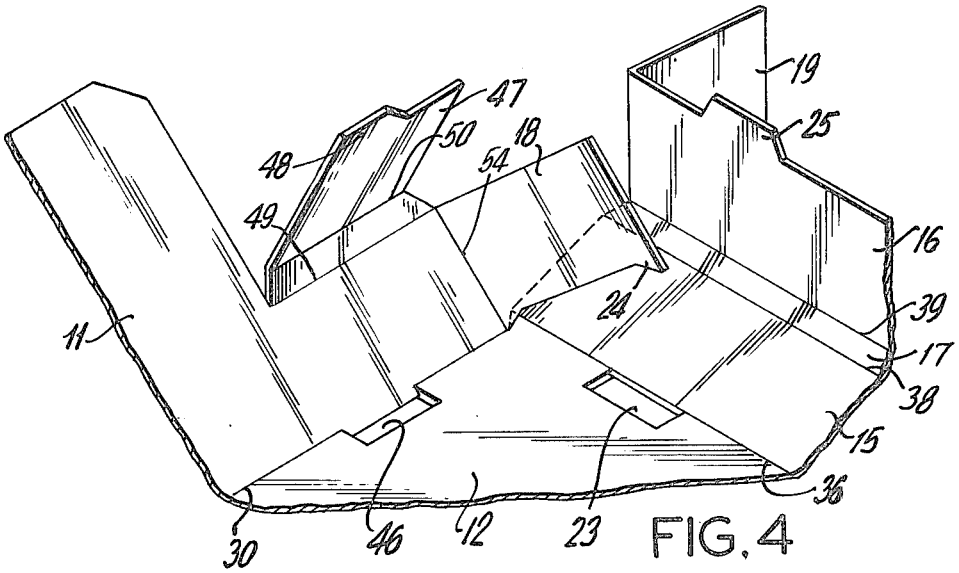
FIGS. 4, 5, and 6 are perspective views sequentially illustrating the steps of erecting the lower end portion of the box structure of FIG. 3.
Figure 5:
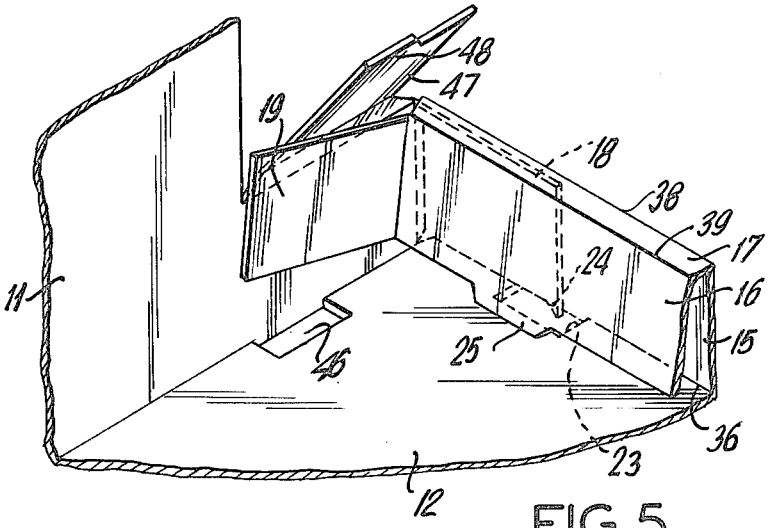
Figure 6:
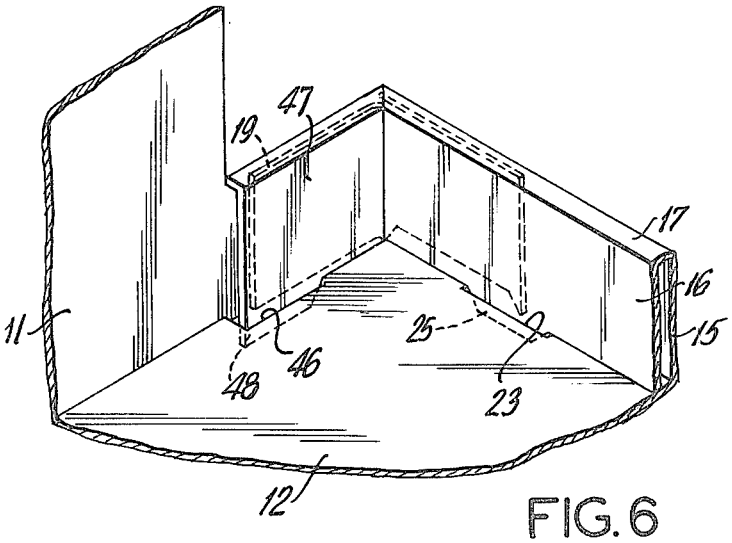

In a modified storage bin as shown in unfolded condition in FIG. 3, like reference numerals indicate like component parts shown in the preceding example. In this embodiment, the tuck means include a single tuck flap portion 19 connected laterally to the front locking panel 16. The front end portion of the side walls 11 and 11' are reduced in height to match the front wall 15 and reinforcing flap 47 is connected to the lowered side wall portion along score lines 49 and 50. The opposite side of the reinforcing flap 47 is provided with a locking tab 48 that in assembled condition of the bin engages a lock slot 46 provided in the bottom panel 12. The assembly of this storage bin corresponds substantially to that in the preceding example with the exception that the tuck flap portion 19 is folded to abut on the inner surface of the side wall 11 along the score line 49 and the reinforcing flap 47 is folded over the tuck flap 19 and engaged by its locking tab 48 with the locking slot 46. The sequential folding of the front wall 15 is illustrated in FIGS. 4, 5, and 6.

It will be understood that each of the elements described above, or two or more together, may also find a useful application in other types of constructions differing from the types described above.

It will also be understood that the box of the invention can be constructed of cardboard, corrugated board, milk carton board and the like.

While the invention has been illustrated and described as embodied in a die-cut one-piece storage bin, it is not intended to be limited to the details shown, since various modifications and structural changes may be made without departing in any way from the spirit of the present invention. For example, the design described does not use staples although it is possible to staple the folded portions for even more structural strength.

What is claimed as new and desired to be protected by Letters Patent is set forth in the appended claims:

1. A storage bin assembled by folding a one-piece card- or corrugated board structure, comprising: a bottom panel; two opposite side wall panels connected respectively to lateral sides of the bottom panel along lateral score lines; rear wall panel connected to the rear side of the bottom panel along a rear score line; a rear locking panel connected to the other side of the rear wall panel along intermediate rear score lines; rear flaps connected to the rear side of each side wall panel and foldable about the score line; rear locking means including rear lock tabs projecting respectively from lateral sides of said rear locking panel, said side wall panels including rear locking slots provided respectively in the rear end portions thereof to receive said rear lock tabs when said bin is folded in its assembled conditions; front wall panel connected to the front side of the bottom panel along a front score line; a front locking panel connected to the other side of the front wall panel along intermediate front score line; short front flaps connected respectively to a lower portion of the front side of each side wall panel along a short score line; tuck means including tuck flaps connected respectively at their short sides to the lateral sides of said front locking panel along score lines to bear against inner surface portions of respective side walls, said tuck flaps including tuck flap portions connected laterally to said front locking panel and foldable about parallel score lines, said side walls including tuck slots provided in the front end portion thereof opposite said short front flap and being spaced apart from the latter approximately a distance corresponding substantially to the length of one of said tuck flap portions, with the remaining tuck flap portions passing from inside to outside of said bin through said tuck slot and with a tuck flap portion being inserted into the space between said short front flap and said front locking panel for engaging and locking in position said tuck flaps; and front locking means including front lock tabs projecting from the other side of the front locking panel; with said bottom panel including front lock slots provided in the front end portion thereof for engaging said front lock tabs when the bin is in its assembled condition.

2. A storage bin as defined in claim 1, wherein an intermediate panel portion is provided between said front wall and said front locking panel, said intermediate panel portion being bounded by score lines spaced apart about the double thickness of said card- or corrugated board.

3. A storage bin assembled by folding a one-piece card- or corrugated box structure, comprising: a bottom panel; two opposite side wall panels connected respectively to lateral sides of the bottom panel along lateral score lines; rear wall panel connected to the rear side of the bottom panel along a rear score line; a rear locking panel connected to the outer side of the rear wall panel along intermediate rear score line; rear flaps connected to the rear side of each side wall panel and foldable along the score line; and rear locking means including rear lock tabs projecting respectively from lateral sides of said rear locking panel, said side wall panels including rear locking slots provided respectively in the rear end portion thereof to receive said rear lock tabs when said bin is folded in its assembled condition; front wall panels connected to the front side of the bottom panel along a front score line; a front locking panel connected to the other side of the front wall panel along intermediate front score line; short front flaps connected respectively to the lower portion of the front side of each side wall panel along a short score line; tuck means including tuck flaps connected respectively at their short sides to lateral sides of said front locking panel along score lines to bear against inner surface portions of the respective side walls; front locking means including front lock tabs projecting from the outer side of the front locking panels, with said bottom panel including front lock slots provided in the front end portion thereof for engaging said front lock tabs when the box is in the assembled condition; and wherein the front portions of said side walls are reduced in height and are provided with reinforcing flaps foldable along score lines extending parallel to the lateral score lines of said bottom panel, with locking tabs projecting from the free lateral side of said reinforcing flaps, and with said bottom panel including locking slots to engage said locking tabs on said reinforcing flaps.

4. A storage bin as defined in claim 3, wherein an intermediate panel portion is provided between said front wall and said front locking panel, said intermediate panel portion being bounded by score lines spaced apart about the double thickness of said card- or corrugated board.

* * * * *